United States Patent [19]

Zeni et al.

[11] 4,197,958

[45] Apr. 15, 1980

[54] CONTAINER OF FOAMED THERMOPLASTIC MATERIAL

[76] Inventors: Antonio Zeni, Via Arlasa, 6, Tesero (Trento), Italy; Rudi Steinlein, Almbachstrasse, 8, Munich, Fed. Rep. of Germany

[21] Appl. No.: 948,254

[22] Filed: Oct. 3, 1978

[30] Foreign Application Priority Data

Oct. 4, 1977 [IT] Italy ..... 22418/77[U]

[51] Int. Cl.[2] ..... B65D 7/42; B65D 87/00

[52] U.S. Cl. ..... 220/72; 220/7.4; 220/1.5; D9/177; 206/503

[58] Field of Search ..... 220/66, 70, 72, 83, 220/DIG. 15, 74, 73, 1.5, 66; 206/427, 505, 511; D9/177, 248

[56] References Cited

U.S. PATENT DOCUMENTS

| | | | |
|---|---|---|---|
| D. 242,660 | 12/1976 | Astle | D9/177 X |
| D. 248,280 | 6/1978 | Martin | D9/177 X |
| 3,047,189 | 7/1962 | Paul | 206/503 X |
| 3,307,729 | 3/1967 | Schwartz | 220/72 X |
| 3,628,684 | 12/1971 | Sere | 220/72 X |

*Primary Examiner*—Steven M. Pollard

*Attorney, Agent, or Firm*—Darbo & Vandenburgh

[57] ABSTRACT

The container has four walls and a base plate. The walls join at vertical double-walled corners. The base plate has corrugations running diagonally thereacross, which corrugations are of trapezoidal cross section. Vertical ribs extend between the corrugations on the underside of the base plate. Along the top of the walls is a band of "E" shaped cross section between each adjacent pair of corners. Below each band the wall tapers outwardly to a vertical lower portion. The wall below each band tapers inwardly to the inner wall of the double-walled corner. The walls, corners and base plate are integral and have supplemental feet welded thereto, each foot being below a respective corner.

5 Claims, 7 Drawing Figures

CONTAINER OF FOAMED THERMOPLASTIC MATERIAL

BACKGROUND AND SUMMARY OF THE INVENTION

The present invention relates to a container of thermoplastic foamed synthetic material, on the order or magnitude of, for example 0.5–1 cubic meters, which is constructed in such a way that despite large dimensions, large useful volume and simple construction, it is very light, very sturdy and stackable by means of fork trucks, and also transportable by means of roller conveyor.

Without going into detail concerning the known containers of this type and general size which are made of wood or of reinforced plastic, there is one prior art container (German unexamined patent specification OS 23 64 417) which is comparable with the container of the present invention in respect to its purpose of use and the material of which it consists. That container consists of a base plate reinforced by a star-and-ring ribbing with support plates arranged underneath the base plate, which support plates also are ribbed. Such a construction is extremely complicated and expensive to manufacture. The required hollow spaces provided for the introduction of the forks of a fork truck are in the form of special recesses, which likewise complicate the manufacture of the container. Since the base plate with star-and-ring ribbing apparently is not sufficiently sturdy, there have to be provided the surrounding support plates mentioned.

In contrast to this a container embodying the present invention has a base plate formed with trapezoidal waves which in the simplest and most weight-saving manner yield a very sturdy base. Consequently support plates become unnecessary and it suffices to employ simple feet at the four lower corners of the base plate, which feet provide the required spacing for the introduction of the forks of a fork truck.

Further advantageous details of the container of the invention will be apparent from the following description of an embodiment represented in the appended drawing.

DESCRIPTION OF SPECIFIC EMBODIMENT

Figure 1:
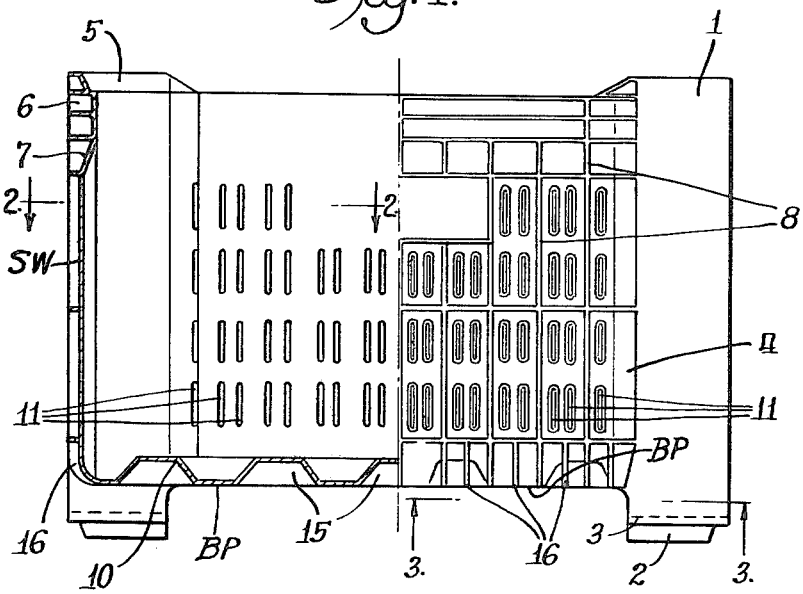
FIG. 1 is an elevational view, with the left half broken away to show a section as seen at line 1—1 of FIG. 2.
Figure 4:
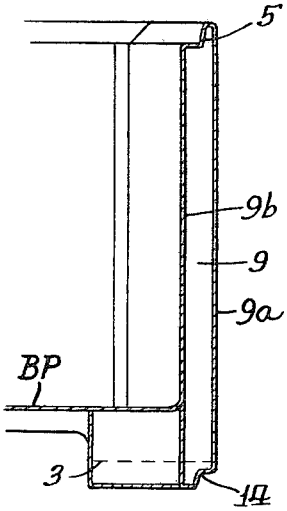
FIG. 4 is a section as seen at line 4—4 of FIG. 3.
Figure 2:
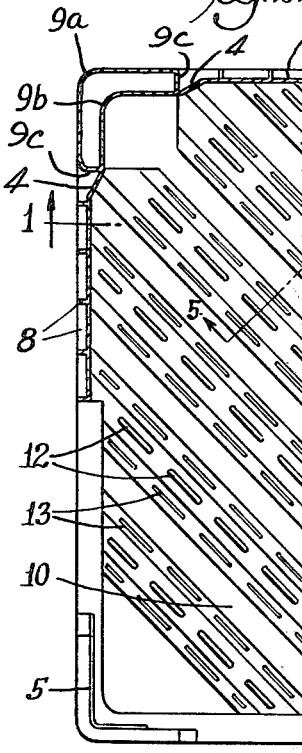
FIG. 2 is a partial plan view, with the top half broken away to show a section as seen at line 2—2 of FIG. 1.
Figure 3:
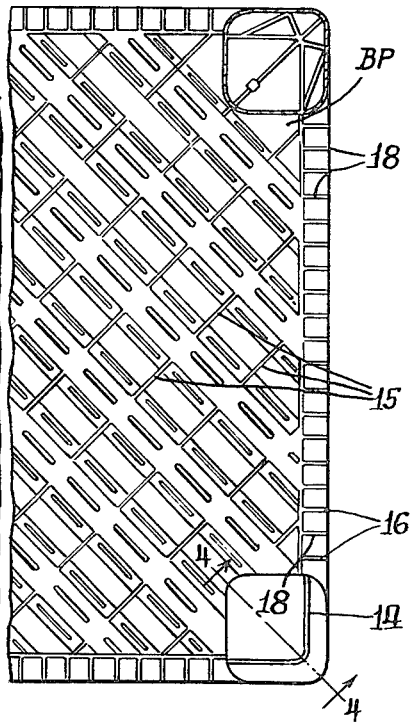
FIG. 3 is a partial bottom view, with the foot at the top corner broken away to show a section as seen at line 3—3 of FIG. 1.

The following disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or further improvements.

The open top container is a one-piece body 1, formed by four side walls SW and a base plate BP. Four feet 2 are welded at 3 to the lower corners of the base plate.

At each of the top corners, there are upwardly extending, "L" shaped walls 5. These are located to fit about feet 2 of a second container which was to be stacked onto the container illustrated and to thus center the upper container on the lower one. To facilitate such stacking the bottommost portion of the feet 2 are tapered inwardly in the downwardly direction as seen at 14.

The side walls SW meet at double-walled corners. Thus there are outer walls **9*a* and inner walls 9*b*, both of which consist of two portions positioned generally in the shape of an "L" in transverse cross section, and which define a space 9 therebetween. These inner and outer walls are spaced apart a distance substantially less than the length of said portions and, at the distal ends of the portions, are joined by vertical sections 9*c* to form the double walled corner which has a generally "L" shape in transverse cross section. A vertically aligned transition portion 4 of the side wall connects the major part of each of the side walls to the inner wall 9*b*** of each of the double-walled corners adjacent to the respective side wall.

Extending between each adjacent pair of corners and along each of the sides at the top edges of the sides of the container are three ribs which are generally parallel to each other and to the respective top edge and which, along with the contiguous part of the respective side, define an E-shaped band 6. This imparts great stability to the side walls when the container is filled. Underneath the E-band 6 the side walls have an outwardly tapering section 7. Thus the side walls therebelow are farther apart so that the useful volume of the container is increased. On the outside of the side walls there are provided vertical and horizontal strengthening ribs 8 which extend to the bottom of the base plate. Along the bottom are a plurality of intermediate ribs 16, each positioned between a respective pair of vertical ribs 8. These provide additional protection should the fork of a lift truck strike the container during the course of loading the container thereon and facilitate that procedure of getting the fork below the container.

The base plate is formed with a series of corrugations 10 of trapezoidal cross section. Preferably these extend diagonally. These corrugations are all generally parallel to each other. Such corrugations assure that the base of the container has good rigidity with low weight as compared to the known constructions having ribbed bases. Across the bottom of the base plate, and transversely between the corrugations 10 are a plurality of thin walls or ribs 15. The bottom edges of these ribs 15 are level with the bottom of the corrugations. These not only add rigidity to the corrugations, but also provide additional support surfaces when a container is supported on the fork of a lift truck and thus prevent damage to the base plate.

Figure 5:
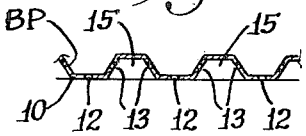
FIG. 5 is a partial section as seen at line 5—5 of FIG. 2.
Figure 6:
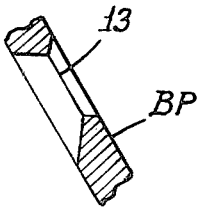
FIG. 6 is an enlarged fragmentary section showing the side of a rib and one of the openings therein.
Figure 7:
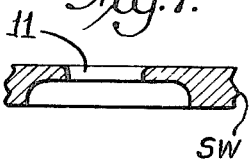
FIG. 7 is an enlarged fragmentary section of a side wall showing one of the openings therein.

The side walls have ventilation openings 11, in themselves known. As seen in FIG. 7, the edges about these openings are rounded inward to avoid damage to the contents. Likewise, in the base plate there are openings 12. The inclined sides of the base plate corrugations have openings 13 of the double-trapezoidal form shown in FIG. 5 for the purpose of facilitating manufacture.

We claim:

1. A container of foamed plastic for transporting and storing bulk goods, such as agrarian products, said container comprising four side walls meeting at corners and a base plate extending between the walls, said four side walls having upper edges defining an open top of the container, said container being characterized by:

said container comprising a one-piece body of said plastic and four simple feet welded to the one-piece body, said one-piece body including said side walls, corners and base plate, each said side wall being a single thickness of said plastic with an external side on which there are strengthening ribs, said corners being generally "L" shaped in transverse cross-section and being double-walled comprising spaced inner and outer walls, each of said corner walls, as seen in transverse cross-section, consisting of two portions positioned in a generally "L" configuration and the two corner walls being spaced from each other a distance substantially less than the length of said portions and being joined by respective sections at each of the ends of the "L," the base plate having a plurality of corrugations extending diagonally thereacross, all of which corrugations are generally parallel to each other, each of said corrugations being trapezoidal in cross-section.

2. A container as set forth in claim 1, including ribs on the bottom side of the base plate, within the corrugations and transversely to the corrugations, said ribs having bottom edges at the level of the bottom of the corrugations.

3. A container as set forth in claim 1, wherein the strengthening ribs on each of said sides include a band of three ribs immediately adjacent the top edge of the side and generally parallel thereto, said ribs being spaced from each other and in transverse cross-section and with the contiguous part of the side wall having a generally "E" configuration, said band extending between the two corners adjacent to said side, said three ribs having external edges which are substantially coplanar with the outside of the outer corner walls of the two corners adjacent to said side.

4. A container as set forth in claim 3, wherein each of the side walls immediately below said band taper outwardly to a generally vertical lower portion.

5. A container as set forth in claim 4, wherein each of the side walls below said band are outwardly of the inner walls of the two corners adjacent to the respective side and at the ends thereof adjacent said two corners have vertically aligned transitions extending from said generally vertical lower portion inwardly to the inner wall of said double-wall corners.

* * * * *